US010260493B2

(12) United States Patent
Kaufmann

(10) Patent No.: US 10,260,493 B2
(45) Date of Patent: Apr. 16, 2019

(54) MEMBRANE PUMP

(71) Applicant: KNF Flodos AG, Sursee (CH)

(72) Inventor: Stephan Kaufmann, Gunzwil (CH)

(73) Assignee: KNF Flodos AG, Sursee (CH)

( * ) Notice: Subject to any disclaimer, the term of this patent is extended or adjusted under 35 U.S.C. 154(b) by 664 days.

(21) Appl. No.: 14/856,976

(22) Filed: Sep. 17, 2015

(65) Prior Publication Data

US 2016/0076529 A1 Mar. 17, 2016

(30) Foreign Application Priority Data

Sep. 17, 2014 (DE) ..... 10 2014 013 779

(51) Int. Cl.
*F04B 43/02* (2006.01)
*F04B 43/00* (2006.01)

(52) U.S. Cl.
CPC ..... *F04B 43/02* (2013.01); *F04B 43/0054* (2013.01)

(58) Field of Classification Search
CPC ..... F04B 53/22; F04B 43/02; F04B 43/0054
USPC ..... 417/413.2, 477.2
See application file for complete search history.

(56) References Cited

U.S. PATENT DOCUMENTS 4,468,222 A * 8/1984 Lundquist ..... A61M 5/14216 417/236
4,560,326 A 12/1985 Seki
4,594,059 A * 6/1986 Becker ..... F04B 43/02 417/439
4,634,430 A * 1/1987 Polaschegg ..... F04B 43/06 128/DIG. 12
4,743,169 A * 5/1988 Funakawa ..... F04B 45/04 417/306
5,002,471 A * 3/1991 Perlov ..... F04B 43/0054 417/413.1
7,503,910 B2 3/2009 Adahan
8,192,401 B2 * 6/2012 Morris ..... A61M 1/14 604/153
2003/0217962 A1 * 11/2003 Childers ..... A61M 1/28 210/258
2008/0181800 A1 * 7/2008 Muschalek ..... F04B 43/02 417/470

FOREIGN PATENT DOCUMENTS

DE 3438982 5/1985
EP 0307069 7/1992

* cited by examiner

*Primary Examiner* — Charles G Freay
(74) *Attorney, Agent, or Firm* — Volpe and Koenig, P.C.

(57) ABSTRACT

The invention relates to a diaphragm pump (109) having a pump housing (1) on which a disposable cell (2) is releasably fixable, which disposable cell has a first and a second cell wall (3, 4) which (3, 4) define an operating space (5) between them, and having an operating diaphragm (6) which (6) is drivingly connected to an oscillating stroke drive and which (6) is releasably coupleable with the flexible first cell wall (3) on its diaphragm flat side remote from the stroke drive. It is characteristic to the diaphragm pump (109) according to the invention that at least one outlet port (12) in the operating diaphragm (6) is provided with a return flow obstructer or a return flow preventer for evacuating the dead space (11) arranged between it and the first cell wall (3) (cf. FIG. 1).

39 Claims, 8 Drawing Sheets

MEMBRANE PUMP

BACKGROUND

The invention relates to a diaphragm pump having a pump housing on which a disposable cell is releasably fixable, which disposable cell has a first and a second cell wall which define an operating space between them, and having an operating diaphragm which is drivingly connected to an oscillating stroke drive and which is releasably coupleable with the flexible first cell wall on its diaphragm flat side remote from the stroke drive.

Diaphragm pumps for the conveying and metering of liquids are used in very diverse realizations. High demands are placed on such diaphragm pumps in particular in the case of applications in the health and research sectors.

In order to avoid cross contaminations from various fluids, clean and often sterile fluid paths are mandatory. In order to guarantee the cleanliness and sterility of the fluid paths in the previously known diaphragm pumps, said diaphragm pumps have to be cleaned or even sterilized in an expensive and time-consuming manner. Said cleaning and sterilizing processes often pose great challenges to the users as in particular the expenditure on quality control is linked to enormous expense, effort and uncertainty. The latter has to be constantly monitored by way of additional checks and random sampling and reduced to a minimum. The expense and effort required for cleaning and sterilizing can make the costs connected with the operation of such diaphragm pumps soar. The interruptions in the production or research process generated thereby are unwanted and should be able to be reduced to a minimum.

One efficient method to be able to exchange the fluid-conducting path of a pump system in a short time and at the same time ensure that the entire pump system is clean and, where applicable, even sterile when it is ready for use, is provided by the use of quick change components such as, for example, hoses, fittings and the fluid-conducting components of the pump head of a diaphragm pump.

The market already provides a wide selection of hoses and accessories which are available as disposable components.

EP 0 307 069 B1 has already disclosed a diaphragm pump of the type mentioned in the introduction where the fluid-conducting components of the diaphragm pump are provided in a quick-change disposable or single-use cell. To this end, the disclosed diaphragm pump has a pump housing on which the disposable cell is releasably fixable. Said disposable cell comprises a first and a second cell wall which define an operating space between them. The disclosed diaphragm pump comprises an operating diaphragm which is drivingly connected to an oscillating stroke drive. Said operating diaphragm is releasably coupleable with the flexible first cell wall on its diaphragm flat side remote from the stroke drive. In this case, one of the realizations of the disclosed diaphragm pump shown in EP 0 307 069 B1 provides that the dead space arranged between the operating diaphragm and the first cell wall is connected by means of an outlet line, which is guided right through the operating diaphragm, to a non-return valve arranged outside the diaphragm pump. Said non-return valve does allow air compressed between the operating diaphragm and the first cell wall to flow out, but at the same time prevents air flowing back into the dead space remaining between the operating diaphragm and the first cell wall. Consequently, the first cell wall of the disposable cell and the operating diaphragm are held against one another and coupled together as a result of negative pressure or as a result of adhesive forces. As the outlet line, which is guided through the operating diaphragm and extends up to the non-return valve arranged outside the disclosed diaphragm pump, is comparatively long, a certain residual volume of air always remains in said outlet line which expands again during intake and can pass into the dead space arranged between the operating diaphragm and the first cell wall. As a result, not all the volume generated by the operating diaphragm is sucked into the operating space arranged between the cell walls of the disposable cell, which reduces the efficiency and the accuracy of the diaphragm pump disclosed in EP 0 307 069 B1 and can also result in said diaphragm pump no longer being able to prime itself The capacity of the pump to self-prime is, however, a substantial advantage of diaphragm pumps compared, for example, to centrifugal pumps.

In the case of the diaphragm pump mentioned in the introduction, one of the objects consequently includes creating a diaphragm pump where the dead volume in the dead space between the operating diaphragm and the flexible first cell wall is as small as possible or practically zero.

SUMMARY

The solution according to the invention to said object provides in the case of the diaphragm pump of the type mentioned in the introduction in particular in that at least one outlet port in the operating diaphragm is provided with a return flow obstructer or return flow preventer arranged inside the operating diaphragm for evacuating the dead space arranged between it and the first cell wall.

The diaphragm pump according to the invention has an operating diaphragm which comprises a return flow obstructer or return flow preventer inside the at least one outlet port arranged in the operating space. The operating diaphragm, which is separated from the fluid-conducting operating space by the first cell wall of the disposable cell which serves as a blocking diaphragm, is displaced by the oscillating stroke drive into the suction stroke and the pressure stroke. In this case, the first cell wall of the disposable cell, which serves as a blocking diaphragm, lies directly on the surface of the operating diaphragm and fits snugly to the diaphragm surface of the operating diaphragm. During the pressure stroke, the flexible first cell wall is expanded toward the top dead center as a result of the upward movement of the operating diaphragm, which is why, through the tensile stress generated, it is able to abut in an optimum manner against the surface of the operating diaphragm. So that the first cell wall is able to abut in an optimum manner against the diaphragm surface of the operating diaphragm, the air remaining in the dead space located in between has to be able to be displaced or removed. For this reason, there is at least one outlet port in the operating diaphragm, in which outlet port a return flow obstructer or return flow preventer is interposed inside the operating diaphragm. Whilst the return flow obstructer delays the air flowing into the dead space arranged between the operating diaphragm and the first cell wall again, the flowing of air into the dead space again is efficiently prevented by a return flow preventer. As a result, negative pressure, which couples said two flexible components of the diaphragm pump according to the invention to one another, is generated between the first cell wall and the operating diaphragm. Due to the negative pressure generated in the dead space, the first cell wall remains abutting against the operating diaphragm during the suction stroke of said operating diaphragm. Actively pumping out the dead space arranged between the operating diaphragm and the first cell wall is not absolutely necessary. As in the case of the diaphragm pump according to the invention, the non-return valve is not arranged outside the diaphragm pump, but rather inside the operating diaphragm, the dead volume remaining between the dead space and the non-return valve can be kept comparatively small. The diaphragm pump according to the invention is consequently characterized by a high degree of efficiency and a functionally reliable operation.

In order to be able to seal the operating space in the disposable cell in a proficient manner in relation to the surrounding air, it is advantageous when the first cell wall is clamped between the operating diaphragm and the second cell wall in an edge region which defines the operating space.

The handling of the diaphragm pump according to the invention as well as the assembly and disassembly of the disposable cell associated therewith is made considerably easier when the first and the second cell wall are connected together so as to be fluid-tight in an edge region which defines the operating space.

So that the operating diaphragm is able to transmit its downward movement into the bottom dead center in a proficient manner onto the first cell wall of the disposable cell during the suction stroke, it is advantageous when the first cell wall abuts flatly against the operating diaphragm during the downward movement of the operating diaphragm to the bottom dead center.

In order to be able to couple the operating diaphragm and the first cell wall of the diaphragm pump according to the invention with one another in a proficient manner, it is advantageous when that the first cell wall is releasably coupleable with the operating diaphragm by means of negative pressure. In addition to this or instead of it, it can be expedient when the first cell wall is releasably coupleable with the operating diaphragm by means of adhesion.

Accordingly, a further embodiment according to the invention provides that the first cell wall is releasably coupleable with the operating diaphragm by means of prestressing and that, for this purpose, the first cell wall comprises its own elasticity which prestresses the first cell wall in the direction of the operating diaphragm.

In order to delay in a noticeable manner surrounding air flowing again into the dead space arranged between the operating diaphragm and the first cell wall, it is advantageous when the return flow obstructer provided in the at least one outlet port is developed as a nozzle or as a narrowing of the cross section in the outlet port which is restricted to the operating diaphragm. Whilst the air still remaining initially in the dead space is pressed rapidly out through the outlet port during the pressure stroke of the diaphragm pump according to the invention, the surrounding air flowing into the dead space again during the suction stroke of the operating diaphragm is considerably delayed.

Instead of a return flow obstructer in the operating diaphragm, a preferred further development according to the invention provides that the return flow preventer provided in the at least one outlet port is developed as a non-return valve which is movable from a closed position against a restoring force into the open position which opens in the direction opposite the dead space.

In this case, it is expedient when the return flow preventer has a valve body which is movable between the open position and closed position.

An embodiment according to the invention which is particularly simple in design and production provides that the valve body of the return flow preventer is connected integrally to the elastic material of the operating diaphragm.

A particularly structurally simple embodiment according to the invention consists in that that the return flow preventer is realized as a duckbill valve or as a flutter valve.

In the case of a corresponding arrangement of the diaphragm pump according to the invention, it can be advantageous when the valve body of the return flow preventer remains in its closed position during the downward movement of the operating diaphragm to the bottom dead center due to its mass inertia and is moved into the open position during the stroke movement toward to the top dead center.

It is advantageous when the restoring force acting on the valve body is applied by at least one resiliently elastic or rubber-elastic restoring element or by the own elasticity of the valve body.

In order to be able to vary the restoring force where necessary, it is advantageous when the at least one restoring element is realized as a compression spring.

A proven and particularly simple embodiment according to the invention provides that the stroke drive is realized as an eccentric drive.

However, it is also possible for the stroke drive to be realized as a linear drive. In this case, the stroke drive can be realized as an electric or hydraulic stroke drive.

A further development according to the invention provides that the stroke movement of the stroke drive into the top dead center is effected by means of at least one lifting magnet and the downward movement of the operating diaphragm into the bottom dead center is effected by means of a resiliently elastic or rubber-elastic restoring part. However, an embodiment where the stroke movement of the stroke drive into the top dead center is effected by means of a resiliently elastic or rubber-elastic restoring part and the downward movement of the operating diaphragm into the bottom dead center is effected by means of at least one lifting magnet is preferred.

An easily handleable embodiment according to the invention provides that the second cell wall is formed by at least one part region of the side wall facing the first cell wall of a dimensionally stable component of the disposable cell.

In this case, the dimensionally stable component of the disposable cell can be formed by a single-part or multiple-part plastics material block. Such a plastics material block can be produced in a cost-efficient manner at comparatively low expense.

In order to ensure the design and production of a functionally reliable embodiment of diaphragm pump according to the invention, it is advantageous when the dimensionally stable component has two interconnected part elements which the pump inlet and the pump outlet penetrate and that the at least one inlet valve and the at least one outlet valve are provided in the separating plane of the part elements.

The simple design and production of the diaphragm pump according to the invention is promoted when the at least one inlet valve and/or the at least one outlet valve is/are realized as (a) flutter valve(s).

In order to promote consistent pump operation of the diaphragm pump according to the invention, it is advantageous when at least one pulsation damper is provided in the disposable cell in the pump inlet and/or in the pump outlet. In this case, a preferred embodiment according to the invention provides that the at least one pulsation damper is realized as at least one compensating diaphragm which is interposed in the pump inlet and/or the pump outlet.

In the case of the diaphragm pump of the type mentioned in the introduction, a further object includes in particular in creating a diaphragm pump which is distinguished by particularly simple handling.

The solution according to the invention to said object provides in the case of the diaphragm pump of the type mentioned in the introduction in particular in that the disposable cell is releasably fixable on the pump housing without any tools by means of a clamping device.

In the case of the diaphragm pump according to the invention, the disposable cell which comprises the fluid-conducting operating space is releasably fixable on the pump housing without any tools by means of a clamping device.

As the disposable cell is able to be releasably fixed on the pump housing without any tools, the disposable cell can also be releasably fixed on the pump housing by a user who has not receiving any technical training.

In this case, a preferred further development according to the invention provides that the clamping device has a pivot lever which is held on the pump housing so as to be pivotable and is movable between a release position and a hold position. Such a pivot lever which is held on the pump housing so as to be pivotable and is movable between a release position and a hold position is also solely actuatable in a manual manner.

It is particularly advantageous when the pump housing is developed in a divisible manner and has at least two housing parts, between which the disposable cell is releasably clampable. Many applications demand a high level of cleanliness and, where applicable, even of sterility as well as a high level of safety with regard to a threatening cross contamination of fluids. In the case of non-exchangeable system components, time-consuming cleaning and, where applicable, sterilizing processes have to be carried out on the pump system before a next process step can be effected. The carrying out of such cleaning and sterilizing processes is time-intensive and requires an extensive system know-how. Uncertainty as regards parts that are possibly still unclean persists nevertheless after every cleaning process.

In order to be able to couple the disposable cell quickly and with little effort to the operating diaphragm of the diaphragm pump according to the invention located in the pump housing, it is advantageous when the housing parts are movable by means of the clamping device between a holding position where they are brought closer together and a release position where they are correspondingly spaced apart from one another.

A preferred embodiment according to the invention provides that a first housing part, which receives the stroke drive therein, and a second housing part, which is developed as a cover of the diaphragm pump, are provided.

A preferred further development according to the invention provides that the second housing part has a recess into which the disposable cell is insertable in a positive-locking manner. In order to prevent the disposable cell from bursting when the clamping device is opened into the release position, it advantageous when the disposable cell protrudes into the recess for as long as there is overpressure in the operating space.

In order to be able to couple the operating diaphragm and the first cell wall of the disposable cell together always in a positionally correct manner, it is advantageous when positioning aids, which secure an established relative position between the first housing part and the disposable cell, are provided between the first housing part and the disposable cell. A preferred embodiment where the clamping device is securely fixed in the hold position provides that the pivot lever of the clamping device is developed as a toggle lever. In this case, a preferred embodiment consists in that the pivot lever, which is realized as a toggle lever, is held in a self-locking pivot position above the dead point of the toggle lever mechanism in the holding position of the clamping device.

The pivot lever can be additionally secured in the hold position of the clamping device when the pivot lever is movable from the hold position into the release position of the clamping device against the restoring force of at least one resiliently elastic or rubber-elastic restoring element.

The pivot lever can also be secured particularly well in the hold position of the clamping device when the pivot lever is pivotable about a pivot axis which is realized as an eccentric.

The clamping device is capable of holding the disposable cell in a particularly proficient manner on the pump housing when the pivot lever is developed in a bow-shaped manner and clamps or fixes the disposable cell on the pump housing with the cross web of the bow form in the hold position of the clamping device.

A further development according to the invention which is worthy of protection in its own right provides that the diaphragm pump has a pump control means, and that a data storage unit, which interacts with a reader unit in the region of the pump housing, which reader unit communicates in a control manner with the pump control means, is provided on the disposable cell for storing specific data of the disposable cell.

In this case, preferred embodiments according to the invention provide that the data storage unit and the reader unit interact with one another in a wired or wireless manner.

BRIEF DESCRIPTION OF THE DRAWINGS

Further developments according to the invention are produced from the following description in conjunction with the claims as well as the drawing. The invention is described in more detail below by way of preferred exemplary embodiments of the diaphragm pump according to the invention, in which:

DETAILED DESCRIPTION OF THE PREFERRED EMBODIMENTS

Figure 1:
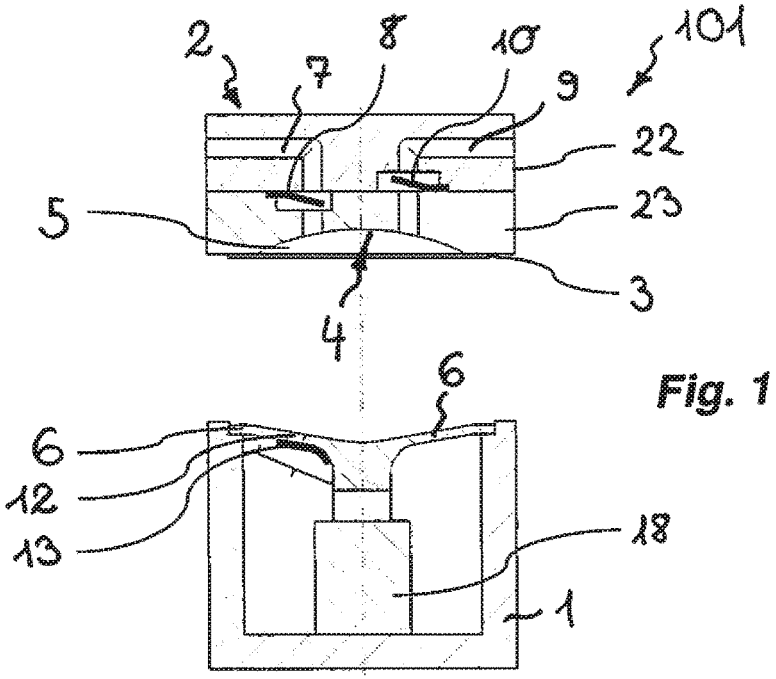
FIG. 1 shows a diaphragm pump with a pump housing on which a disposable cell is releasably fixable, wherein an oscillating stroke drive, which is realized here as a linear drive, is provided in the pump housing and wherein the pump housing and the disposable cell are shown here separately from one another.

FIGS. 1 to 29 show different realizations 101, 102, 107, 109, 116 and 123 of a diaphragm pump. Common to the different realizations 101, 102, 107, 109, 116 and 123 of the diaphragm pump is that they have a pump housing 1 on which a disposable cell 2 is releasably fixable. In order to achieve clean or even sterile fluid paths in said diaphragm pump 101, 102, 107, 109, 116 and 123 and in order to avoid cross contamination of different fluids conveyed in said diaphragm pumps, said disposable cells 2 can be released from the pump housing 1 and, where required, exchanged.

Each of the disposable cells 2 comprises a first and a second cell wall 3 or 4 which defines an operating space 5 between them. An operating diaphragm 6, which is drivingly connected to an oscillating stroke drive and which is releasably coupleable with the flexible first cell wall 3 on its diaphragm flat side remote from the stroke drive, is provided in the pump housing 2 of the diaphragm pumps 101, 102, 107, 109, 116 and 123. In this case, each disposable cell 2 of the diaphragm pumps 101, 102, 107, 109, 116 and 123 comprises a pump inlet 7, which opens out in the operating space 5 and has at least one inlet valve 8, and a pump outlet 9 which is connected to the operating space 5 and has at least one outlet valve 10. A suction stroke and a pressure stroke are carried as a result of the oscillating movement of the operating diaphragm 6. In contrast to conventional diaphragm pumps, the operating diaphragm 6, in this case, is not in direct contact with the fluid to be conveyed. Rather, the operating diaphragm 6, for instance at the largest diameter of the operating space 5, is hermetically separated from the fluid-conducting operating space 5 by a flexible and film-like first cell wall 3 of the disposable cell, which serves as a blocking diaphragm. Due to its arrangement in the pump head, the first cell wall 3, which serves as a blocking diaphragm, rests flatly directly on the surface of the operating diaphragm 6 and fits snugly to the surface of the diaphragm of the operating diaphragm 6. During the pressure stroke, the first cell wall is expanded by the upward movement of the operating diaphragm 6, which is why it is able to abut optimally against the diaphragm surface of the operating diaphragm 6 as a result of the tensile stress generated. The air which initially still remains in the dead space 11 arranged between the operating diaphragm 6 and the first cell wall 3 is able to flow out through an outlet port 12 which is arranged in the operating diaphragm 6 and is restricted to the cross section of the operating diaphragm 6. To evacuate the dead space 11 which is arranged between the operating diaphragm 6 and the first cell wall 3 of the disposable cell 2, the outlet port 12 in the operating diaphragm 6 is provided with a return flow obstructer or a return flow preventer 13.

In the case of the diaphragm pumps 101, 102, 107, 109, 116 and 123 shown here, a return flow preventer 13 is provided which only allows fluid to flow out of the dead space 11, whilst, in contrast, surrounding air or similar fluid is prevented from flowing into the dead space 11 again.

In the hold positions of the disposable cell 2 on the pump housing 1 shown in FIGS. 3, 4, 6, 9 to 11, 15, 21, 22 and 27, the flexibly or elastically developed first cell wall 3 is clamped between the operating diaphragm 6 and the second cell wall 4 in an edge region which defines the operating space 5. In order to facilitate the handling and consequently the assembly and disassembly of the disposable cell 2 on the pump housing 1, the realization shown here is preferred where the first and the second cell wall 3, 4 are connected together so as to be fluid-tight in the edge region which defines the operating space 5.

Once the disposable cell 2 has been placed on the pump housing 1, air possibly remaining in the dead space 11 is able to escape through the outlet port 12 provided in the operating diaphragm 6, whilst, in contrast, air flowing into the dead space 11 is at the same time prevented or at least delayed. As a result, negative pressure, which couples the operating diaphragm 6 and the first cell wall 3 to one another and holds them together in a flat manner, is generated between the operating diaphragm 6 and the first cell wall 3. Thanks to the negative pressure generated as a result, the first cell wall 3 of the disposable cell 2 remains abutting against the operating diaphragm 6 during the suction stroke. An additional vacuum pump or an active external vacuum generating means is not absolutely necessary in order to generate the necessary negative pressure in the dead space 11 between the operating diaphragm 6 and the first cell wall 3.

As the first cell wall 3 abuts flatly against the operating diaphragm 6 during the downward movement of the operating diaphragm 6 toward the bottom dead center, the first cell wall 3 is preferably releasably coupleable here with the operating diaphragm 6 by means of negative pressure or by means of adhesion.

In the case of the realizations 101, 102, 107, 109, 116 and 123 of the diaphragm pump shown here, the return flow preventer 13 provided in the at least one outlet port 12 is realized as a non-return valve which is movable from a closed position against a restoring force into the open position which opens in the direction opposite the dead space 11.

The return flow preventer 13, which is developed as a non-return valve, has a valve body which is movable between the open and the closed position for this purpose. In the case of the diaphragm pump 106 shown in FIG. 6, said non-return valve is realized as a ball valve and the valve body is realized as a valve ball 14. In this case, the restoring force acting on the valve body is applied here by at least one resiliently elastic restoring element. The restoring element is realized here as a compression spring 15.

Figure 6:
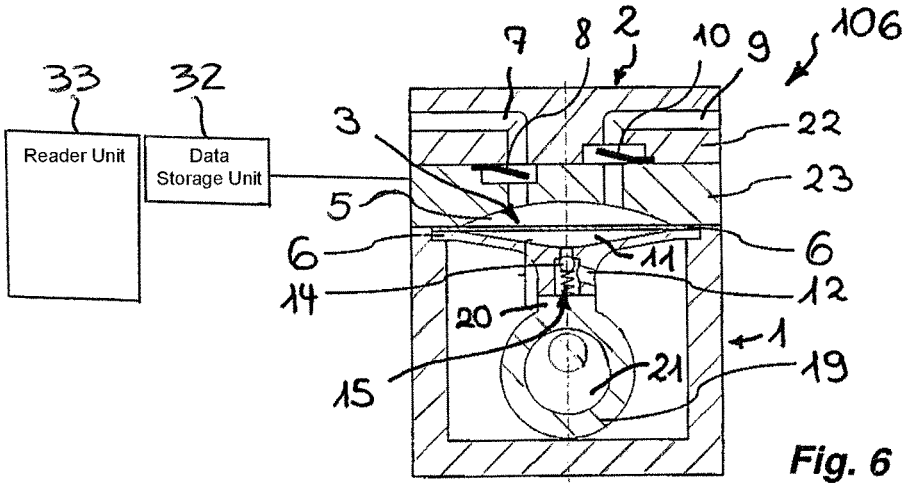
FIG. 6 shows a diaphragm pump which is comparable to FIG. 2 where a return flow preventer provided in an operating diaphragm is realized as a non-return valve and in particular as a ball valve.

FIG. 6 also shows a further development according to the invention with a data storage unit 32 provided on the disposable cell 2 for storing specific data of the disposable cell 2, which interacts with a reader unit 33 in the region of the pump housing 1, which reader unit 33 communicates in a control manner with the pump control means.

In this case, the data storage unit 32 and the reader unit 33 interact with one another in a wired or wireless manner.

Figure 7:
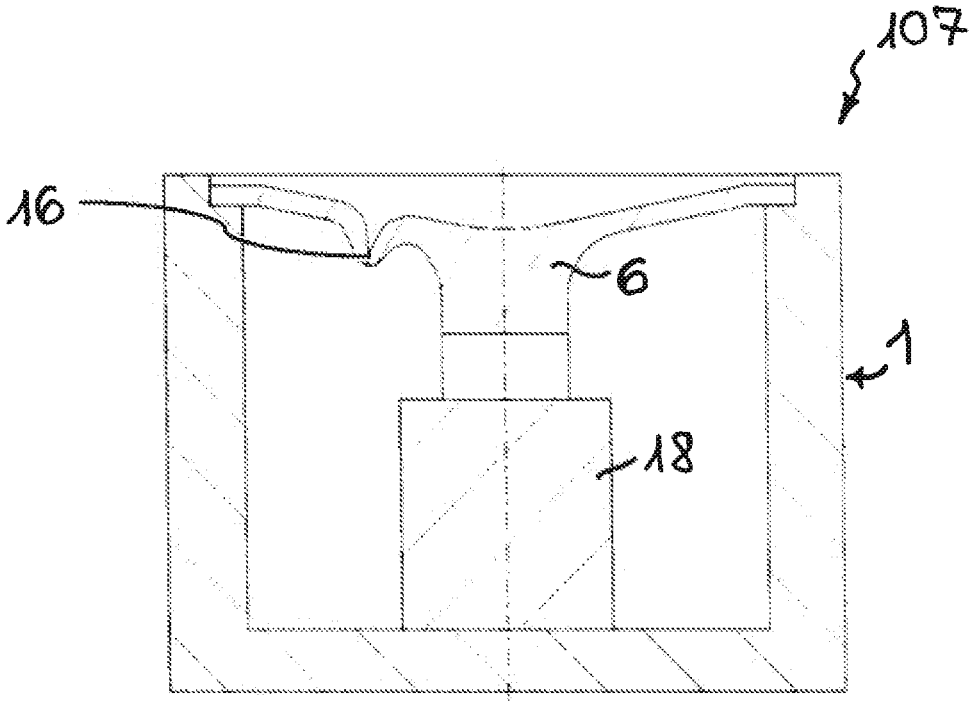
FIG. 7 shows the pump housing of a diaphragm pump where the return flow preventer provided in the operating diaphragm is realized as a duckbill valve.
Figure 8:
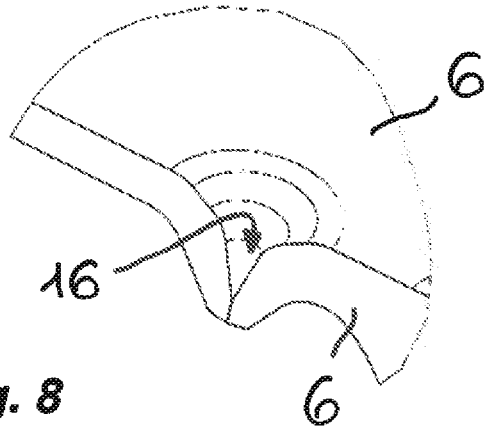
FIG. 8 shows a perspective longitudinal section of a detail of the duckbill valve of the diaphragm pump from FIG. 7 which is integrated into the operating diaphragm.
Figure 9:
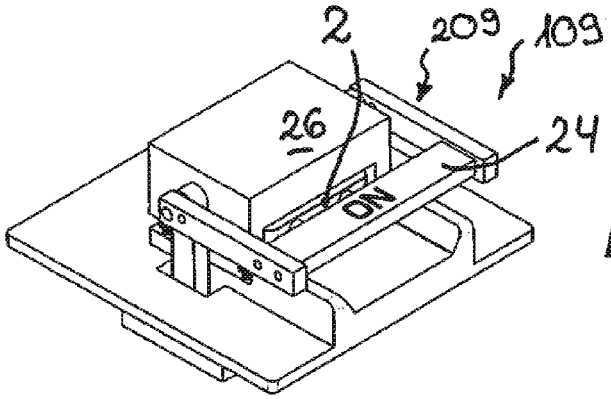
FIG. 9 shows a perspective representation of a diaphragm pump with a divisible pump housing where a disposable cell is clampable and fixable between a first and a second housing part, wherein a clamping device with a pivot lever, which pivot lever is rotatable about an eccentrically mounted pivot axis, is provided for clamping said disposable cell.
Figure 10:
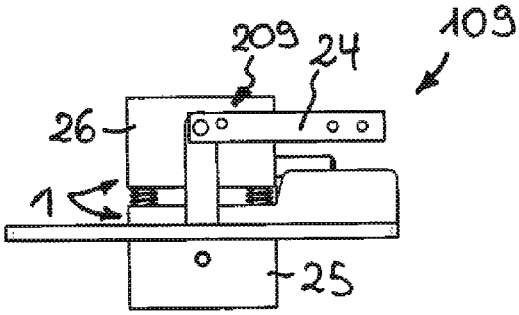
FIG. 10 shows a side view of the diaphragm pump from FIG. 9 with the clamping device in the hold position.
Figure 11:
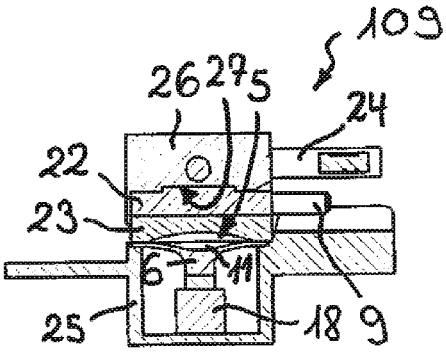
FIG. 11 shows a longitudinal section of the diaphragm pump from FIGS. 9 and 10.
Figure 12:
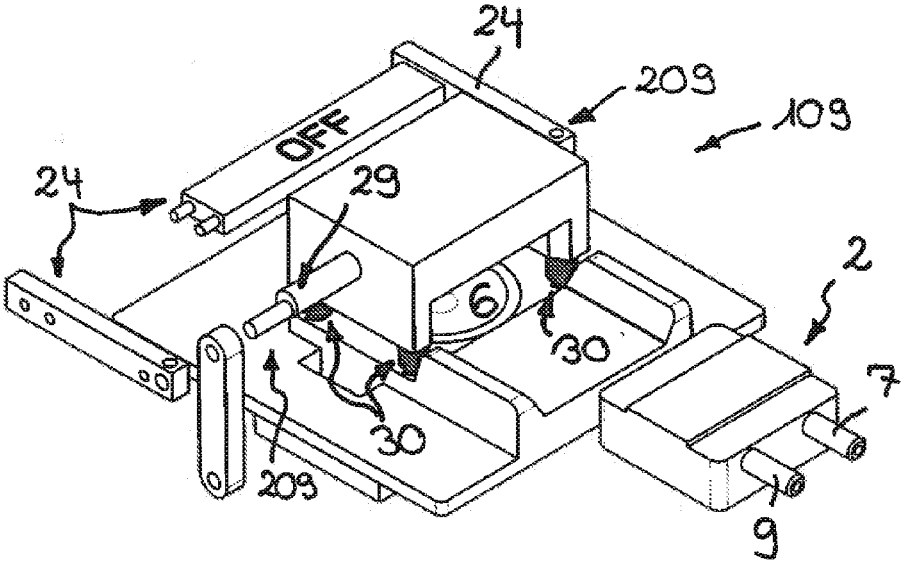
FIG. 12 shows the diaphragm pump from FIGS. 9 to 11 shown in perspective with its clamping device in the release position.
Figure 14:
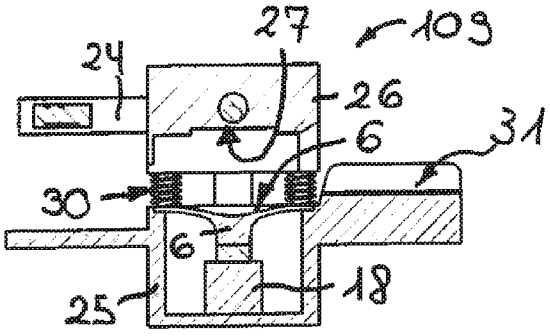
FIG. 14 shows a lateral longitudinal section of the diaphragm pump from FIGS. 9 to 13.
Figure 13:
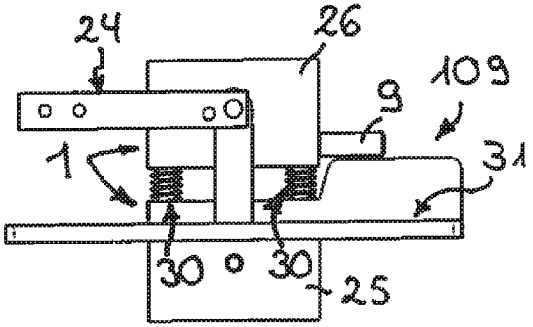
FIG. 13 shows the diaphragm pump from FIGS. 9 to 12 shown in a side view with the clamping device in the release position.
Figure 15:
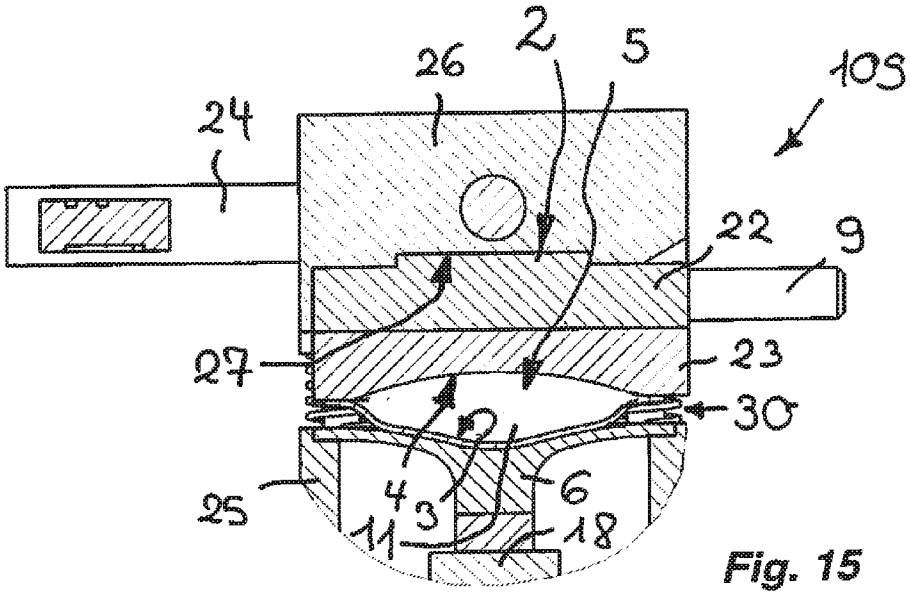
FIG. 15 shows a longitudinally sectioned side view of the diaphragm pump from FIGS. 9 to 14 with the disposable cell inserted into the pump housing, wherein the first cell wall is displaced onto the operating diaphragm as a result of negative pressure in the operating space.
Figure 16:
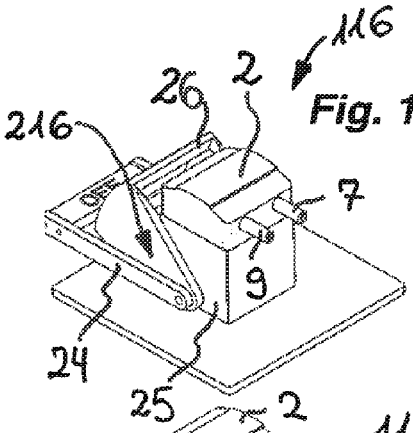
FIG. 16 shows a perspective representation of a diaphragm pump with a first housing part which comprises the stroke drive and a second housing part which is realized as a pivotable cover, wherein, for clamping the disposable cell, the housing parts are clampable against one another by means of a clamping device which includes an eccentrically mounted pivot lever.
Figure 21:
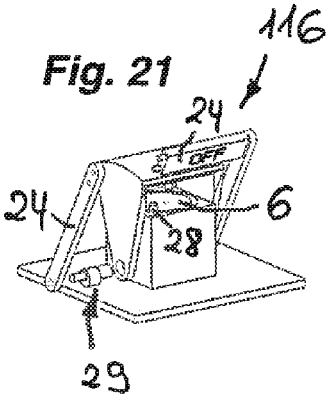
FIG. 21 shows the diaphragm pump from FIGS. 16 to 20 shown in a perspective view, with the pivot lever in the hold position.
Figure 17:
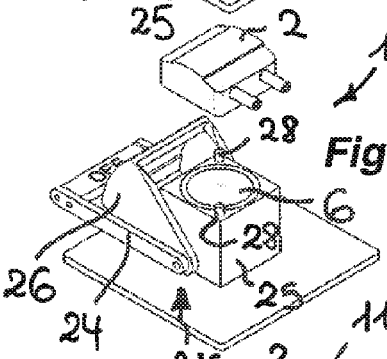
FIG. 17 shows the diaphragm pump from FIG. 16 shown in perspective with the clamping device in the open position, in which open position the disposable cell is releasable from the pump housing.
Figure 18:
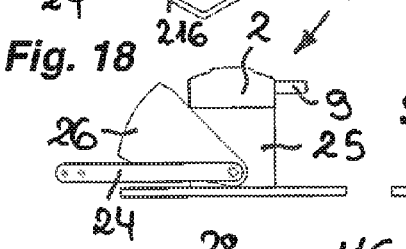
FIG. 18 shows the disposable cell which is still resting unsecured on the pump housing and is shown in a side view, with the clamping device in the release position.
Figure 20:
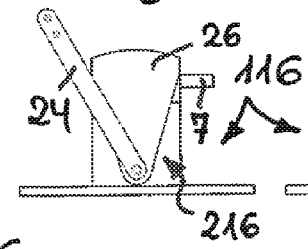
FIG. 20 shows the diaphragm pump from FIGS. 16 to 19 with the pivot lever in an intermediate position arranged between the release and the hold position.
Figure 22:
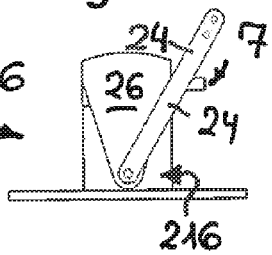
FIG. 22 shows the diaphragm pump from FIGS. 16 to 21 shown in a side view, with the pivot lever in the hold position.
Figure 19:
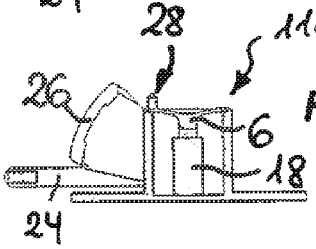
FIG. 19 shows a side longitudinal section of the diaphragm pump from FIGS. 16 to 18 through the pump housing and the clamping device.
Figure 23:
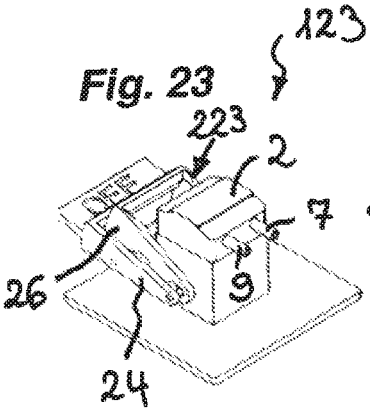
FIG. 23 shows a perspective representation of the diaphragm pump with a clamping device, the pivot lever of which is realized as a toggle lever which has lever arms which are connected in an articulated manner to one another and to a second housing part, a disposable cell is clampable between said second housing part and a first housing part of the pump housing, wherein the clamping device is shown in its release position here.
Figure 25:
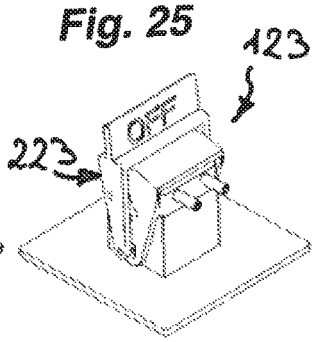
FIG. 25 shows the diaphragm pump from FIG. 24 also shown in perspective with its clamping device which is shown here in an intermediate position between the hold and the release position of the clamping device.
Figure 27:
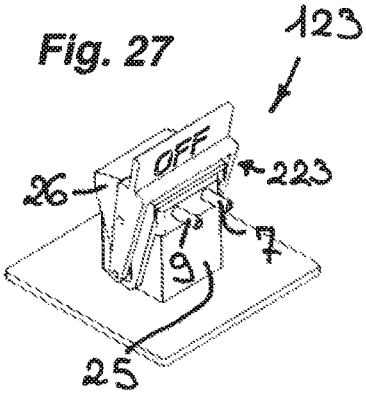
FIG. 27 shows the diaphragm pump from FIGS. 23 to 26 shown here in perspective, with its clamping device in the hold position.
Figure 28:
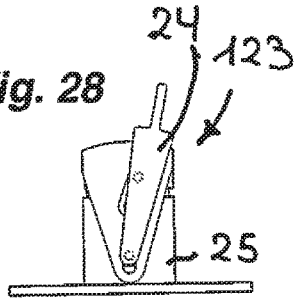
FIG. 28 shows a side view of the diaphragm pump from FIGS. 23 to 27 shown with its clamping device in the hold position.
Figure 26:
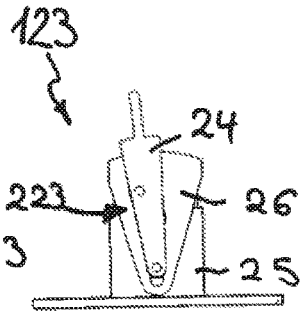
FIG. 26 shows the diaphragm pump from FIGS. 23 to 25 shown here in a side view, in the intermediate position from FIG. 25.
Figure 24:
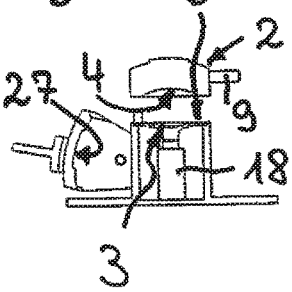
FIG. 24 shows an exploded longitudinal section of individual pump parts of the diaphragm pump from FIG. 23.
Figure 29:
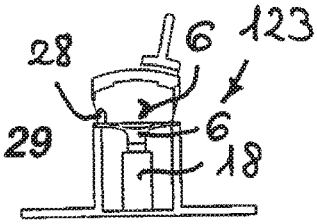
FIG. 29 shows a longitudinal section of the diaphragm pump from FIGS. 23 to 28 shown with the clamping device in the hold position, without the disposable cell.

In the case of the diaphragm pump 107 shown in FIGS. 7 and 8, the non-return valve is realized as a duckbill valve, it being possible for the duckbill-shaped valve body 16 to be connected integrally to the elastic material of the operating diaphragm 6.

The diaphragm pumps 101, 102, 109, 116 and 123 comprise, in contrast, a non-return valve which is realized as a flutter valve 17. The valve body of said flutter valve 17 which is shown in FIGS. 1 to 5 only as an example, could also be connected integrally, for example, to the elastic material of the operating diaphragm 6. In the case of the diaphragm pumps 101, 102, 107, 109, 116 and 123 shown here, the valve body of said flutter valves 17 is produced from a material strip that was originally separate.

The stroke drive of the diaphragm pumps 101, 107, 109 and 123 is realized as an oscillating linear drive 18. Said stroke drive which is realized as a linear drive 18 could be developed as an electric or hydraulic stroke drive. However, it is also conceivable for the stroke movement of the stroke drive into the top dead center to be brought about by means of at least one lifting magnet and the downward movement of the operating diaphragm 6 into the bottom dead center to be brought about by means of a resiliently elastic or rubber-elastic restoring part. However, an embodiment where the stroke movement of the stroke drive into the top dead center is brought about by means of a resiliently elastic or rubber-elastic restoring part and the downward movement of the operating diaphragm 6 into the bottom dead center is brought about by a lifting magnet is preferred.

The stroke drive of the diaphragm pump 102, in contrast, is realized as an eccentric drive 19. Said eccentric drive 19 comprises a connecting rod 20, which is connected in an articulated manner to the operating diaphragm 6 and is mounted 6 so as to be rotatable on an eccentric 21 by way its connecting rod end remote from the operating diaphragm in such a manner that the rotation of the eccentric 21 is converted into an oscillating linear movement of the operating diaphragm 6.

Figure 2:
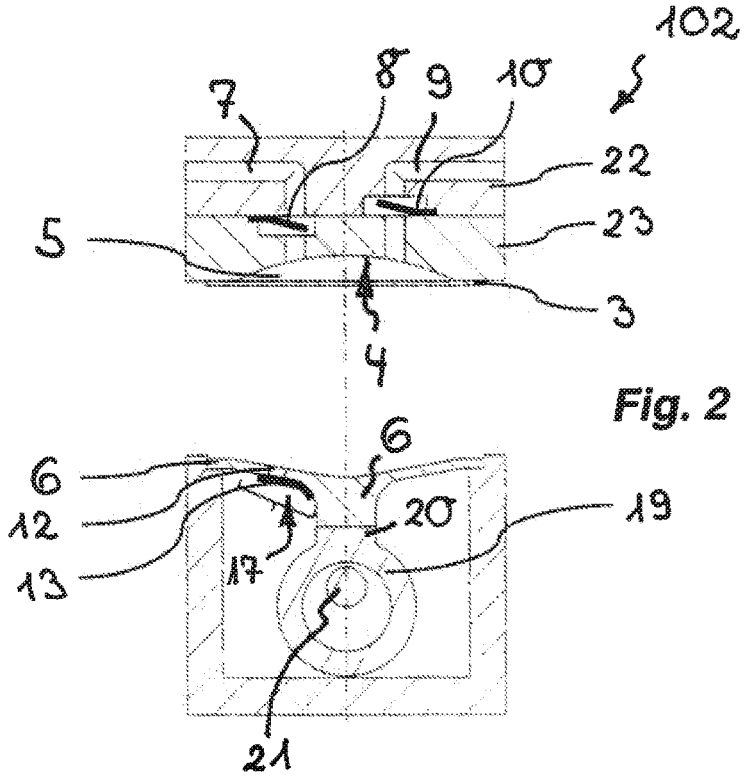
FIG. 2 shows a diaphragm pump which is comparable with FIG. 1 and is also shown in a lateral longitudinal section, the stroke drive of which, arranged in the pump housing, is realized here as an eccentric drive.
Figure 3:
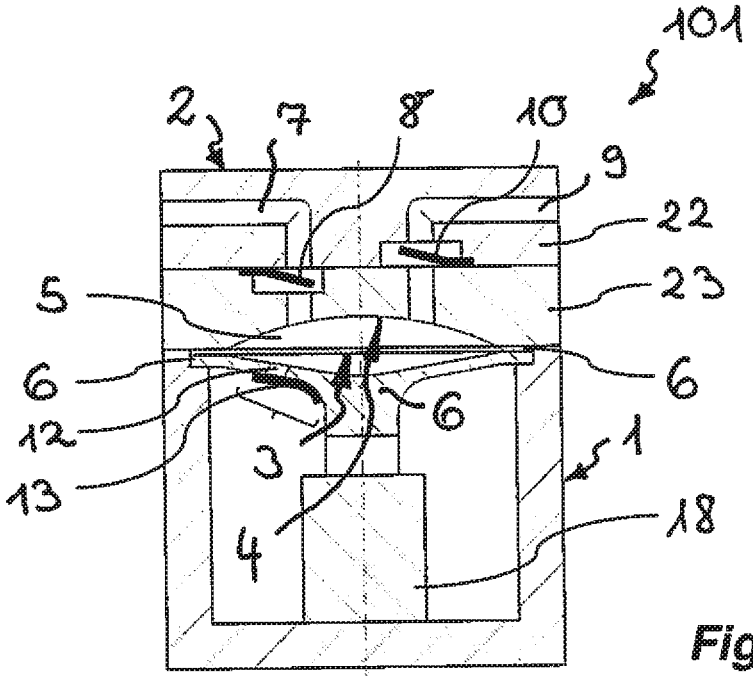
FIG. 3 shows the diaphragm pump from FIG. 1 in a longitudinal section through the pump housing and the disposable cell connected thereto in a position approaching the bottom dead center of the stroke drive prior to the ventilation of the dead space.
Figure 4:
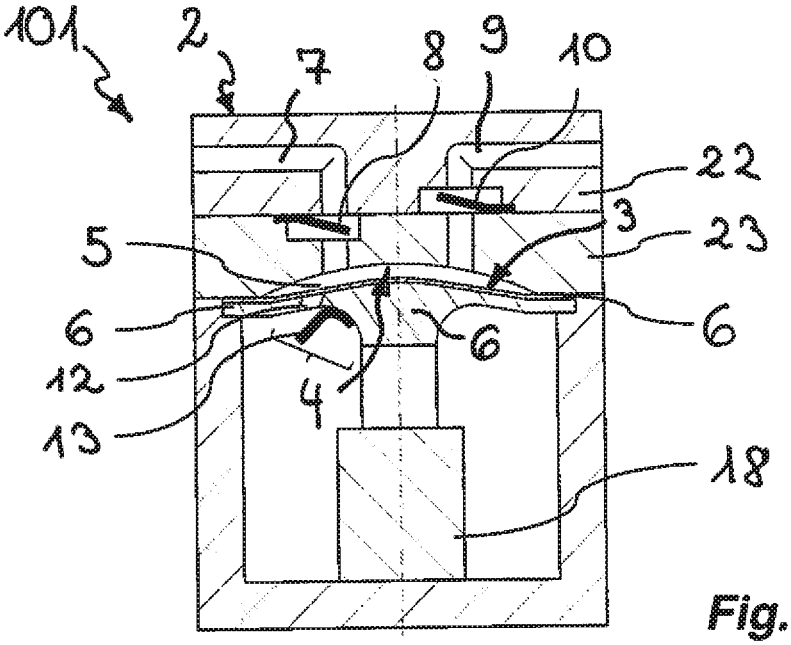
FIG. 4 shows the diaphragm pump from FIGS. 1 and 3 in a position approaching the top dead center of the stroke drive.
Figure 5:
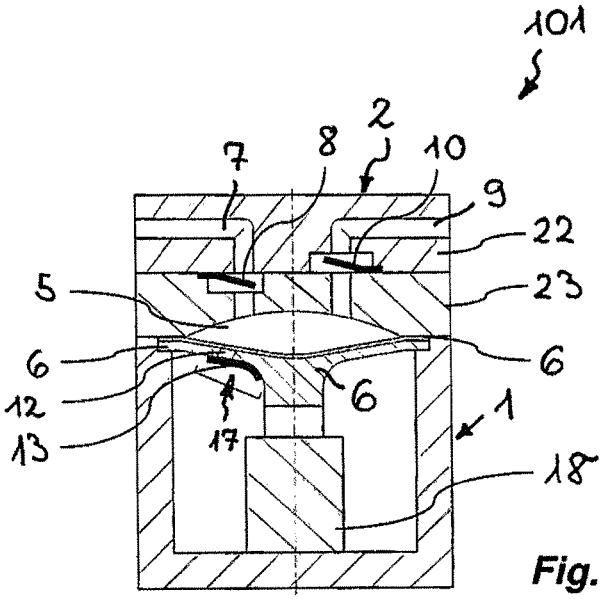
FIG. 5 shows the diaphragm pump from FIGS. 1, 3 and 4 in a position approaching the bottom dead center of the stroke drive.

It is particularly easy to see in FIGS. 1 and 2 that the second cell wall 4 is formed by a part region of the side wall, facing the first cell wall 3, of a dimensionally stable component of the disposable cell 2 which is formed here by a single-part or multiple-part plastics material block. Here said dimensionally stable component comprises two part elements 22, 23 which are connected together and which the pump inlet 7 and the pump outlet 9 penetrate, the at least one inlet valve 8 and the at least one outlet valve 10 being provided in the separating plane of the part elements 22, 23. It can be seen in the figures that the at least one inlet valve 8 and the at least one outlet valve 10 are also realized here as flutter valves.

In order to homogenize the fluid conveying of the diaphragm pumps 101, 102, 107, 109, 116 and 123 shown here, it is expedient when at least one pulsation damper—not shown here in any detail—is provided in the disposable cell 2 in the pump inlet 7 and/or in the pump outlet 9. Said pulsation damper can be realized as at least one compensating diaphragm which is interposed in the pump inlet 7 and/or the pump outlet 9. It can be seen in FIGS. 9 to 29 that the disposable cell 2 is releasably fixable on the pump housing 1 without any tools by means of a clamping device. FIGS. 9 to 29 show different realizations 209, 216 and 223 of such a clamping device. The clamping devices 209, 216, 223 comprise a manually actuatable pivot wing 24 which is held so as to be pivotable on the pump housing 1 and is movable between a release position and a hold position. In this case, the pump housing 1 is developed in a divisible manner and comprises at least two housing parts 25, 26, between which the disposable cell 2 is releasably clampable. The housing parts 25, 26 are movable by means of the clamping device between a hold position where they are moved closer to one another and a release position where, in contrast, they are spaced apart from one another.

Whilst the first housing part 25 receives the stroke drive within itself, the second housing part 26 is developed as a cover. A recess 27, into which the disposable cell 2 is insertable in a positive-locking manner, is provided in said second housing part 26. In this case, the disposable cell 2 protrudes into the recess 27 for as long as there is negative pressure in the operating space 5. Positioning aids, which secure a fixed relative position between the first housing part 25 and the disposable cell 2, are provided between the first housing part 25 and the disposable cell 2. Said positioning aids can be formed by positioning journals 28 which protrude on the first housing part 25 or on the disposable cell 2 and protrude in positioning recesses in the respectively other component 2, 25.

For inserting the disposable cell 2, the clamping device has to be open and be situated in its release position, in which release position the position description "off" can be seen on the cross web of the bow-shaped pivot lever 24. In this case, the disposable cell 2 is placed onto a pre-positioning surface 31 and pushed into the opening that is formed between the housing parts 25, 26 in the release position. In said release position, the second housing part 26, which serves as a cover, is at a sufficient spacing from the first housing part 25, which includes the stroke drive, such that the disposable cell is able to be pushed in transversely with respect thereto. The pivot lever 24 of the clamping device is then pivoted from the "off" position toward the "on" position. As can be seen in FIGS. 9 to 22 by way of the clamping devices 209 and 216, the pivot lever 24 is pivotable about a pivot axis 29 which is realized as an eccentric.

It can be seen in FIGS. 9 to 12 that, in the case of the clamping device 209, the pivot lever 24 can be moved against the restoring force of at least one resiliently elastic restoring element 30 from the hold position into the release position of the clamping device 209. The resiliently elastic restoring elements 30 of the clamping device 209, which are realized here as restoring springs, have the job, on the one hand, of pressing the second housing part 26, which serves as a cover, as far away as possible from the first housing part 25, which receives the stroke drive, and should, on the other hand, generate a certain friction moment on the eccentric pivot axis 29 such that the pivot lever 24 stops in any arbitrary position and does not drop into an end position as a result of gravity. Should pressure still be present in the hoses or in the disposable cell 2 when the clamping device 209 is opened, the first cell wall 3 of the disposable cell 2, which serves as a blocking diaphragm, would be pressed outward and the disposable cell correspondingly pressed into the recess 27 which is provided in the housing part 26. The disposable cell 2 engaging behind in this way in the recess 27 of the second housing part 26 prevents the disposable cell 2 from being pulled unintentionally out of the second housing part 26. The first cell wall 3 then still abuts namely for the most part against the operating diaphragm 6 and is consequently protected against bursting. In this way, uncontrolled disassembly of the disposable cell 2 under compressive load is prevented, which is conducive to health and safety at work.

In the case of the realization 216 of the clamping device shown in FIGS. 16 to 22, the pivot lever 24 has to be situated in the pivot position shown in FIGS. 16 to 19 so that the disposable cell 2 is able to be placed onto the positioning journal 28 protruding on the first housing part 25. As a result of pivoting the pivot lever 24 into the intermediate position shown in FIG. 20, the second housing part 26, which serves as a cover, is pushed over the disposable cell 2. If the pivot lever 24 is then pivoted further into the hold position of the clamping device 216 shown in FIGS. 21 and 22, the clamping devices 216 can press the disposable cell 2 onto the operating diaphragm 6 with its first cell wall 3, the disposable cell 2 resting and being fixed securely on the first housing part 25. The end position of the eccentric pivot axis of the pivot lever 24 is once again arranged somewhat above the dead center such that the clamping device 216 is closed in a self-locking manner. To remove or exchange the disposable cell 2, the pivot lever 24 of the clamping device 216 can also be moved from the hold position shown in FIGS. 21 and 22 into the intermediate position shown in FIG. 20. If there is still pressure in the hoses and in particular in the operating space 5 of the disposable cell 2 in said intermediate position, the engagement-behind brought about between the second housing part 26 and the disposable cell 2 located in the recess 27 of the second housing part 26 prevents the pivot lever 24 from pivoting any further or the second housing part 26, which serves as a cover, from pivoting away.

The clamping device 223 shown in FIGS. 23 to 29 comprises a pivot lever 24 which is realized as a toggle lever. In this case, the pivot lever 24 of the clamping device 223, realized as a toggle lever, is held in a self-locking pivot position above the dead center of the toggle lever mechanism in the hold position shown in FIGS. 27 to 29. The insertion of the disposable cell 2 is effected in the case of the clamping device 223 shown in FIGS. 23 to 29 for instance just as in the case of the clamping device 216 according to FIGS. 16 to 22. However, the second housing part 26 remains unchanged along the pivot radius in the intermediate position according to FIGS. 25 to 26, on the one hand, and in the hold position according to FIGS. 27 to 29 on the other hand. As in FIGS. 27 to 29 the smaller lever arm of the toggle lever is once again arranged slightly above the dead point thereof, the clamping device 223 is also locked in a self-locking manner in the hold position.

LIST OF REFERENCES

1 Pump housing
2 Disposable cell
3 First cell wall
4 Second cell wall
5 Operating space
6 Operating diaphragm
7 Pump inlet
8 Inlet valve
9 Pump outlet
10 Outlet valve
11 Dead space
12 Outlet channel
13 Return flow preventer
14 Valve ball
15 Duckbill valve
16 Duckbill-shaped valve body
17 Flutter valve
18 Linear drive
19 Eccentric drive
20 Connecting rod
21 Eccentric
22 First part element
23 Second part element
24 Pivot lever
25 First housing part
26 Second housing part

27 Recess
28 Positioning journal
29 (Eccentric) pivot axis
30 Restoring element
31 Pre-positioning surface
32 Data Storage Unit
33 Reader Unit
101 Diaphragm pump (according to FIGS. 1 and 3 to 5)
102 Diaphragm pump (according to FIG. 2)
106 Diaphragm pump (according to FIG. 6)
107 Diaphragm pump (according to FIGS. 7 and 8)
109 Diaphragm pump (according to FIGS. 9 to 15)
116 Diaphragm pump (according to FIGS. 16 to 22)
123 Diaphragm pump (according to FIGS. 23 to 29)
209 Clamping device (according to FIGS. 9 to 15)
216 Clamping device (according to FIGS. 16 to 22)
223 Clamping device (according to FIGS. 23 to 29)

The invention claimed is:

1. A diaphragm pump (101, 102, 107, 109, 116, 123) comprising:

a pump housing (1), a disposable cell (2) that is releasably fixable to the pump housing, said disposable cell has a flexible first cell wall and a second cell wall (3, 4) which define an operating space (5) therebetween, an oscillating stroke drive, an operating diaphragm (6) drivingly connected to the oscillating stroke drive, said operating diaphragm (6) is connected at an operating diaphragm edge region to the pump housing and releasably coupleable with the flexible first cell wall (3) on a diaphragm flat side remote from the stroke drive, and at least one outlet port (12) is defined through the operating diaphragm (6) in an area radially inwardly from the operating diaphragm edge region providing a communication path into an interior of the pump housing on an opposite side of the operating diaphragm from the first flexible cell wall, and a return flow obstructer or a return flow preventer is connected to the operating diaphragm in the interior of the pump housing for evacuating a dead space (11) arranged between the operating diaphragm (6) and the flexible first cell wall (3).

2. The diaphragm pump as claimed in claim 1, wherein the flexible first cell wall and the second cell wall (3, 4) each include an edge region at which they are clamped to the pump housing to define the operating space (5).

3. The diaphragm pump as claimed in claim 1, wherein the flexible first cell wall and the second cell wall (3, 4) are connected together so as to be fluid-tight in an edge region which defines the operating space (5).

4. The diaphragm pump as claimed in claim 1, wherein the flexible first cell wall (3) lies against the operating diaphragm (6) during a downward movement of the operating diaphragm (6) to a bottom dead center.

5. The diaphragm pump as claimed in claim 1, wherein the flexible first cell wall (3) is releasably coupleable with the operating diaphragm (6) by negative pressure.

6. The diaphragm pump as claimed in claim 1, wherein the flexible first cell wall (3) is releasably coupleable with the operating diaphragm (6) by adhesion.

7. The diaphragm pump as claimed in claim 1, wherein the flexible first cell wall (3) is releasably coupleable with the operating diaphragm (6) by prestressing thereof via an elasticity of the flexible first cell wall (3) itself in a direction of the operating diaphragm (6).

8. The diaphragm pump as claimed in claim 1, wherein the return flow obstructer provided in the at least one outlet port (12) is formed as a nozzle or as a narrowing of a cross section in the outlet port (12).

9. The diaphragm pump as claimed in claim 1, wherein the return flow obstructer is provided in the at least one outlet port (12) and comprises a non-return valve which is movable from a closed position against a restoring force into an open position which opens in a direction opposite the dead space (11).

10. The diaphragm pump as claimed in claim 1, wherein the return flow obstructer is provided in the at least one outlet port (12), and the return flow obstructer has a valve body which is movable between the open position and the closed position.

11. The diaphragm pump as claimed in claim 10, wherein the valve body is connected integrally to an elastic material of the operating diaphragm (6).

12. The diaphragm pump as claimed in claim 1, wherein the return flow preventer comprises a duckbill valve or a flutter valve.

13. The diaphragm pump as claimed in claim 10, wherein the valve body remains in a closed position during a downward movement of the operating diaphragm (6) to a bottom dead center due to a mass inertia and is moved into an open position during a stroke movement toward to a top dead center.

14. The diaphragm pump as claimed in claim 10, wherein a restoring force acting on the valve body is applied by at least one resiliently elastic or rubber-elastic restoring element or by an elasticity of the valve body itself.

15. The diaphragm pump as claimed in claim 14, wherein the at least one restoring element (15) comprises a compression spring.

16. The diaphragm pump as claimed in claim 1, wherein the stroke drive comprises an eccentric drive.

17. The diaphragm pump as claimed in claim 1, wherein the stroke drive comprises a linear drive.

18. The diaphragm pump as claimed in claim 1, wherein the stroke drive comprises an electric or hydraulic stroke drive.

19. The diaphragm pump as claimed in claim 1, wherein a stroke movement of the stroke drive into a top dead center is effected by at least one lifting magnet and a downward movement of the operating diaphragm (6) into a bottom dead center is effected by a resiliently elastic or rubber-elastic restoring part.

20. The diaphragm pump as claimed in claim 1, wherein a stroke movement of the stroke drive into a top dead center is effected by a resiliently elastic or rubber-elastic restoring part and a downward movement of the operating diaphragm (6) into a bottom dead center is effected by at least one lifting magnet.

21. The diaphragm pump as claimed in claim 1, wherein the second cell wall (4) is formed by at least one part region of a side wall facing the first cell wall (3) of a dimensionally stable component of the disposable cell (2).

22. The diaphragm pump as claimed in claim 21, wherein the dimensionally stable component of the disposable cell (2) is formed by a single-part plastics material block.

23. The diaphragm pump as claimed in claim 22, wherein the dimensionally stable component (2) has interconnected part elements (22, 23) which a pump inlet (7) and a pump outlet (9) penetrate, and at least one inlet valve (8) and at least one outlet valve (10) are provided in a separating plane of the interconnected part elements (22, 23).

24. The diaphragm pump as claimed in claim 23, wherein the at least one inlet valve (8) or the at least one outlet valve (10) or both comprise flutter valves.

25. The diaphragm pump as claimed in claim 1, further comprising a clamping device, and the disposable cell (2) is releasably fixable on the pump housing (1) without any tools by the clamping device (209, 216, 223).

26. The diaphragm pump as claimed in claim 25, wherein the clamping device (209, 216, 223) has a pivot lever (24) which (24) is held so as to be pivotable on the pump housing (1) and is movable between a release position and a hold position.

27. The diaphragm pump as claimed in claim 25, wherein the pump housing (1) has first and second housing parts (25, 26), between which the disposable cell (2) is releasably clampable.

28. The diaphragm pump as claimed in claim 27, wherein the first and second housing parts (25, 26) are movable by the clamping device (209, 216, 223) between a holding position where they are brought closer together and a release position where they are correspondingly spaced apart from one another.

29. The diaphragm pump as claimed in claim 27, wherein the first housing part (25) receives the stroke drive therein, and the second housing part (26) is a cover of the diaphragm pump.

30. The diaphragm pump as claimed in claim 27, wherein the second housing part (26) has a recess (27) into which the disposable cell (2) is insertable in a positive-locking manner.

31. The diaphragm pump as claimed in claim 30, wherein the disposable cell (2) protrudes into the recess (27) for as long as there is overpressure in the operating space (5).

32. The diaphragm pump as claimed in claim 27, wherein positioning aids which secure an established relative position between the first housing part (25) and the disposable cell (2) are provided between the first housing part (25) and the disposable cell (2).

33. The diaphragm pump as claimed in claim 26, wherein the pivot lever (24) of the clamping device (223) is a toggle lever.

34. The diaphragm pump as claimed in claim 33, wherein the pivot lever (24), is held in a self-locking pivot position above a dead center of the toggle lever in the hold position of the clamping device (223).

35. The diaphragm pump as claimed in claim 34, wherein the pivot lever (24) is movable from the hold position into the release position of the clamping device (209, 216) against a restoring force of at least one resiliently elastic or rubber-elastic restoring element (30).

36. The diaphragm pump as claimed in claim 33, wherein the pivot lever (24) is pivotable about a pivot axis (29) which is formed as an eccentric.

37. The diaphragm pump as claimed in claim 26, wherein the pivot lever (24) is bow-shaped and clamps or fixes the disposable cell (2) on the pump housing (1) with a cross web thereof in the hold position of the clamping device (209, 216, 233).

38. The diaphragm pump as claimed in claim 1, wherein the diaphragm pump has a pump control, and a data storage unit is provided on the disposable cell (2) for storing specific data of the disposable cell (2), the pump control interacts with a reader unit in a region of the pump housing (1), said reader unit communicates with the pump control and reads information from the data storage unit on the disposable cell (2).

39. The diaphragm pump as claimed in claim 38, wherein the data storage unit and the reader unit interact with one another in a wireless manner.

* * * * *